United States Patent [19]
Sauer

[11] 4,317,641
[45] Mar. 2, 1982

[54] LOCKING CONNECTION FOR SUPPORTING GRID SYSTEMS

[75] Inventor: Gale E. Sauer, Williamsville, N.Y.

[73] Assignee: Roblin Industries, Inc., Buffalo, N.Y.

[21] Appl. No.: 146,436

[22] Filed: May 5, 1980

[51] Int. Cl.[3] ..... F16B 7/22
[52] U.S. Cl. ..... 403/347; 52/667
[58] Field of Search ..... 403/347, 346, 207, 252; 52/667, 484

[56] References Cited

U.S. PATENT DOCUMENTS

| | | |
|---|---|---|
| 2,840,200 | 6/1958 | Wong . |
| 3,093,221 | 6/1963 | Purdy . |
| 3,221,466 | 12/1965 | Downing, Jr. et al. . |
| 3,221,846 | 12/1965 | Brown et al. . |
| 3,239,035 | 3/1966 | Znamirowski . |
| 3,297,345 | 1/1967 | Downing, Jr. . |
| 3,399,915 | 9/1968 | Stanzak . |
| 3,501,185 | 3/1970 | Brown et al. . |
| 3,898,784 | 8/1975 | Sauer et al. . |
| 3,921,363 | 11/1975 | Beynon . |
| 3,979,874 | 9/1976 | Cubbler, Jr. et al. . |
| 4,108,563 | 8/1978 | Brown et al. . |
| 4,161,856 | 7/1979 | Brown et al. ..... 52/667 |

*Primary Examiner*—Andrew V. Kundrat
*Attorney, Agent, or Firm*—Christel, Bean & Linihan

[57] ABSTRACT

A first support member having a web with a slot and a pair of second support members having locking connectors insertable through the slot in side by side relation, each connector having a resiliently yieldable finger engageable against the web after insertion through the slot for interlocking the first and second members. Each connector has a laterally projecting detent on the side opposite the finger, an opening providing an arcuate generally vertical shoulder spaced rearwardly from the detent, and a laterally projecting spring retainer on the same side as the detent extending forwardly at least partially across the opening. When the connectors are inserted through the slot in side by side relation the forward end of each connector is confined against the other connector by the retainer thereof with its detent engaging the arcuate shoulder of the other connector, thereby interlocking the second support members, the retainers yielding resiliently to permit passage of the detents into the respective openings. The arcuate shoulders accommodate generally vertical relative angular movement of the second support members, the retainers maintaining the interlock during relative angular movement both vertically and horizontally. In one form, the openings and spring retainers are elongated to accommodate axial expansion of the members under elevated temperatures.

10 Claims, 11 Drawing Figures

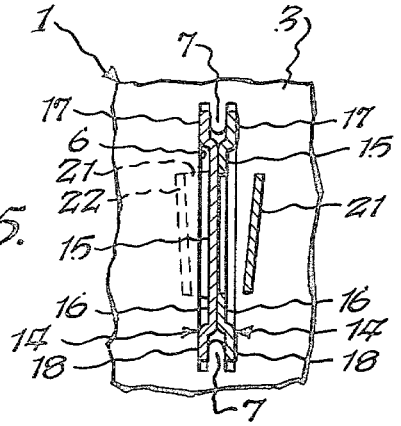
Fig. 5.
Fig. 6.
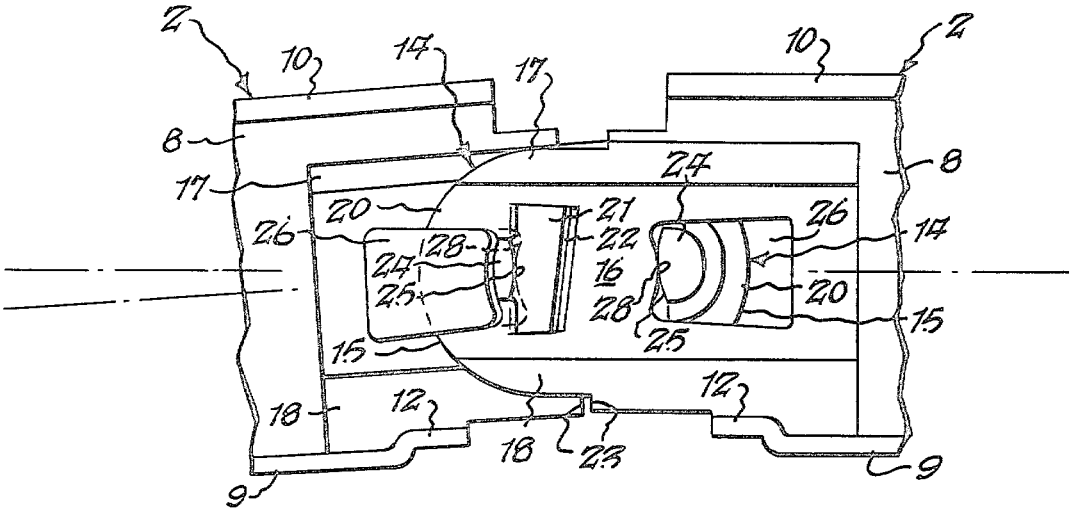
Fig. 7.
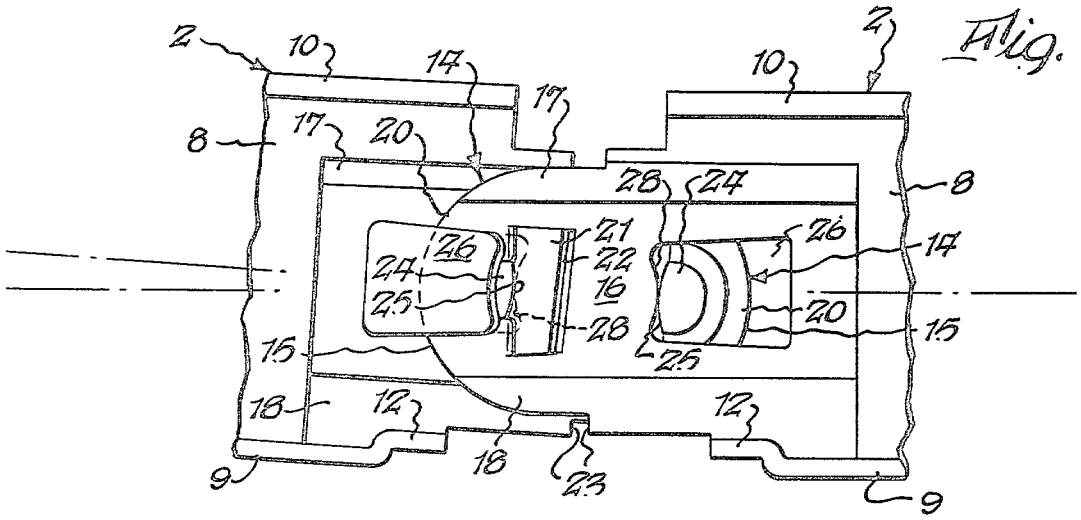

LOCKING CONNECTION FOR SUPPORTING GRID SYSTEMS

BACKGROUND OF THE INVENTION

This invention relates generally to a new and useful locking connection for supporting grid systems such as those used to support ceiling tiles in suspended ceilings.

Such systems customarily comprise a plurality of parallel main tee members and a plurality of parallel cross tee members extending between the main tee members in right angular relation, the cross tees having locking connectors insertable through the main tees and typically interlocking therewith. In some systems, to provide increased resistance against unwanted separation, the locking connectors also interlock with each other as shown for example in U.S. Pat. No. 3,922,829.

Building codes in areas believed to be subject to seismic disturbances have been revised to require ever higher standards of performance under a variety of conditions subjecting such systems to forces tending to separate the grid members.

In addition, many installations require the integrity of the ceiling to be maintained for a predetermined period of time under elevated temperature conditions caused by fire.

SUMMARY OF THE INVENTION

A primary object of this invention is to provide a locking connection for supporting grid systems capable of withstanding severe tension loads tending to pull them apart, and to accommodate both horizontal and vertical relative angular movement of the interconnected cross tees without separation under such conditions of loading.

Another object of this invention is to provide the foregoing in a locking connection accommodating expansion of the interlocked cross tees under elevated temperature conditions while maintaining the cross tee interlock.

It is also an object of this invention to accomplish the foregoing with a supporting grid locking connection which is quickly and easily assembled, relatively simple and inexpensive in construction, and extremely durable and dependable under conditions of field assembly and use.

The foregoing and other objects, advantages and characterizing features of this invention will become apparent from the ensuing detailed description of two illustrative embodiments thereof taken in conjunction with the accompanying drawing illustrating the same, wherein like reference numerals denote like parts throughout the various views.

BRIEF DESCRIPTION OF THE DRAWING FIGURES

FIG. 5 is a fragmentary, transverse sectional view taken about on line 5—5 of FIG. 2;

FIG. 6 is a view like that of FIG. 2 but illustrating the interlocked cross tees with one cross tee bent or pivoted vertically in one direction relative to the other, the main tee being ommitted for convenience in illustration;

FIG. 7 is a view like that of FIG. 6 but illustrating the one cross tee pivoted vertically in the opposite direction;

DETAILED DESCRIPTION OF THE ILLUSTRATED EMBODIMENTS

Figure 1:
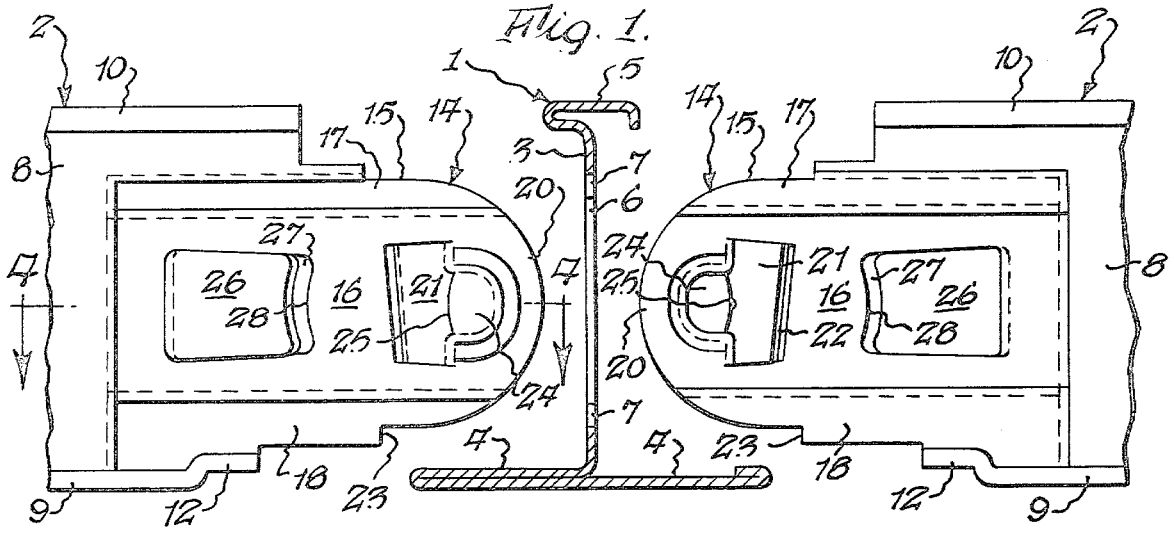
FIG. 1 is a view in side elevation of two cross tee locking connector of this invention just prior to insertion through a main tee slot, the main tee being shown in transverse section and the cross tees being broken away for convenience in illustration.
Figure 2:
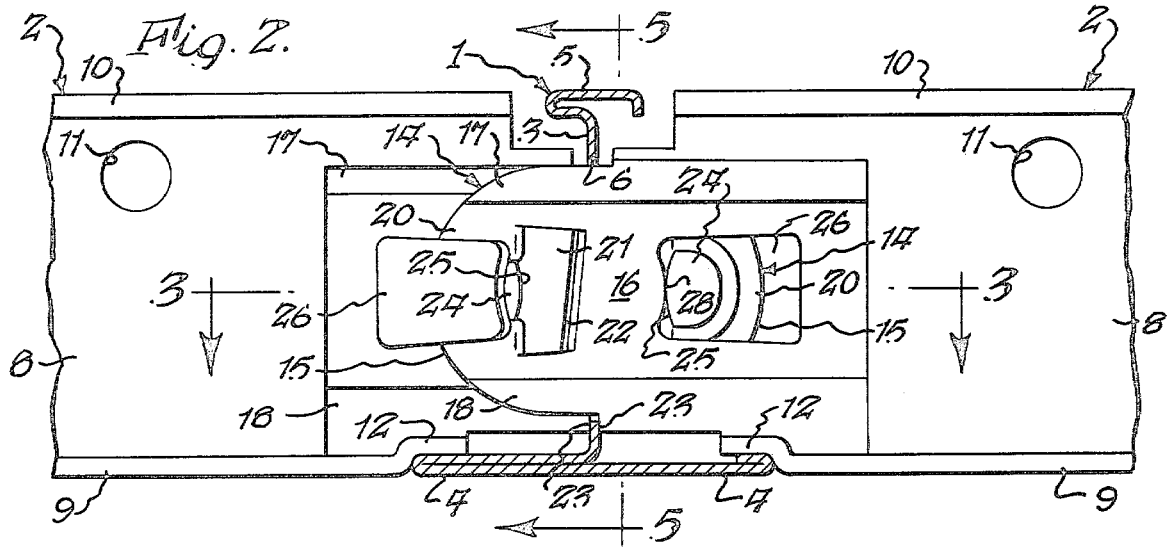
FIG. 2 is a view like that of FIG. 1, but showing the cross tees and main tee in fully assembled, interlocked relation.
Figure 3:
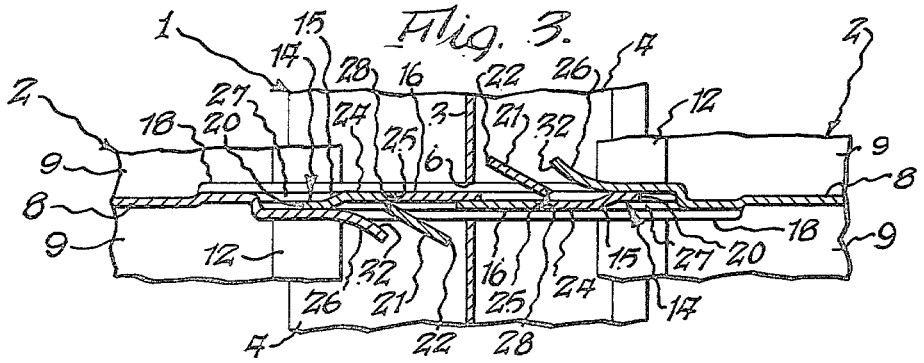
FIG. 3 is a fragmentary, longitudinal sectional view through the assembled cross and main tees taken about on line 3—3 of FIG. 2.
Figure 4:
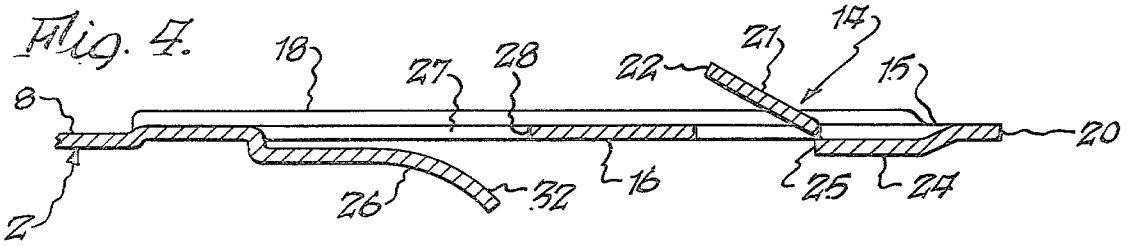
FIG. 4 is a fragmentary, longitudinal sectional view of one of the locking connectors, taken about on line 4—4 of FIG. 1 on an enlarged scale.
Figure 8:
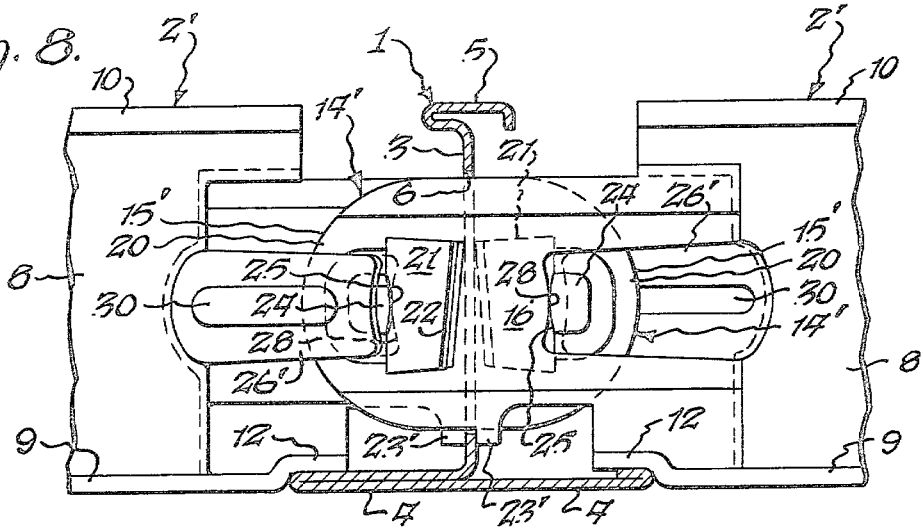
FIG. 8 is a view like that of FIG. 2 but illustrating a modified locking connector designed to accommodate expansion of the cross tees under elevated temperature conditions.

Referring first to the embodiment of FIGS. 1–7 there is shown a supporting grid system incorporating a locking connection of this invention and comprising a main tee support member, generally designated 1 and a pair of opposing cross tee support members generally designated 2. Each main tee 1 can be formed of a single piece of suitable metal to provide a web 3 upstanding from tile supporting flanges 4 extending laterally from opposite sides thereof and having a generally rectangular, longitudinally extending reinforcing bead 5 along the upper edge thereof.

Main tee 1 has a slot 6 therein, subdivided by tab projections 7 extending inwardly of the slot from the upper and lower edges thereof, in spaced relation to the opposite side edges of the slot, as shown in FIG. 5. Such slots 6 are customarily provided at spaced intervals lengthwise of the main tee 1.

Each cross tee 2 also can be formed from a single piece of suitable metal to provide a web 8 upstanding from tile supporting flanges 9 projecting laterally on opposite sides thereof and surmounted by a reinforcing bead 10 which can be similar in construction to the bead 5 of main tee 1. Each cross tee is provided with hanger holes 11 at spaced points therealong, and similar hanger holes are provided at spaced points along main tee 1. At the opposite ends of each cross tee 2 the supporting flanges 9 are upwardly offset, as shown at 12, to provide lip portions overlapping the main tee flanges 4 when the tees are assembled.

Each cross tee 2 is provided at its opposite ends with a locking connector, generally designated 14, formed as an integral extension of web 8 and projecting axially outwardly from the opposite ends of each cross tee 2. Connectors 14 are laterally offset from web 8, in opposite direction at opposite ends of each tee 2, and are formed to provide a channel shaped tongue 15 comprising a recessed web body 16 slightly offset from web 8 and upper and lower longitudinally extending further offset portions 17 and 18, the channel configuration thus provided serving to mechanically reinforce the locking connectors and provide rigidity thereto.

The leading or forward end 20 of each tongue 15 is adapted for insertion through slot 6, with opposing tongues being inserted on opposite sides of projections 7. Each tongue 15 is formed with a resiliently yieldable finger 21 struck from the metal of tongue web 16 at a location spaced rearwardly from leading end 20. Fingers 21 extend outwardly and rearwardly from the associated tongues 15, each finger having an outer edge 22 adapted to engage against the web 3 of main tee 1 after the associated tongue 15 has been inserted through slot 6, to interlock support tees 1 and 2, the fingers 21 resiliently yielding to permit passage through slot 6. Tongue 15 is provided with a step 23 in its lower edge, forming a stop shoulder engageable against web 3 of main tee 1 on the side opposite spring finger 21 to limit insertion of tongue 15 through slot 6 during assembly.

The material of each tongue web 16 is struck out laterally, in a direction opposite finger 21 adjacent the juncture thereof with web 8, to provide detent 24 having a rearwardly facing arcuate edge 25. A spring retainer 26 is struck out laterally from the web 16 of each tongue 15, in rearwardly spaced relation to finger 21 and detent 24, providing an opening 27 in web 16 having an arcuate forward vertical edge 28 defining a shoulder engageable by the edge 25 of detent 24 on the opposing connector.

When assembling the locking connection, a cross tee 2 is assembled to main tee 1 by inserting its tongue 15 through slot 6 until its locking finger 21 snaps into position behind the main tee web, engaging the same to prevent unintentional withdrawal of the cross tee. The spring finger edge 22 is inclined from the vertical, to provide for such engagement while accommodating manufacturing tolerances. The opposing cross tee 2 is assembled to main tee 1 by inserting its locking tongue 15 through the same slot 6 but on the opposite side of the projection 7, until its tongue 21 springs into position behind web 3 for engagement therewith to prevent unintentional withdrawal of that cross tee. As the paired cross tees are thus assembled, the forward edge 20 of each connector passes between the spring retainer 26 and web 16 of the other connector until its locking detent 24 is positioned within cutout 27 for engagement of detent edge 25 against the shoulder 28 of the other connector. This is the fully assembled condition illustrated in FIG. 3, wherein the opposing cross tees are interlocked with each other against separating movement.

It is a particular feature of this invention that detent 24 can be of a size and laterally offset to an extent providing an abutting edge 25 offering full width engagement with shoulder 18, thereby providing considerable resistance against separating movement. The spring retainers 26 resiliently yield to permit passage of the enlarged detents 24. Once the detents 24 are positioned in transverse alignment with the cutout portions 27, spring retainers 26 resiliently urge the opposing connector detents into the cutouts 27 and resist lateral movement of the detents out of the cutouts. This causes the interlock between detent edges 25 and shoulders 28 to be maintained, and thereby maintains the integrity of the cross tee interlock even if one cross tee is moved out of alignment with the other in a horizontal plane, for example in the plane of the paper as viewed in FIG. 3. Therefore, the resilient retaining action of spring members 26 will maintain detent edges 25 in engagement with shoulders 28 and prevent separation upon relative angular horizontal movement of the interlocked cross members.

Similarly, because shoulder 28 is of arcuate formation and of vertical extent substantially greater than the vertical height of detent 24 when its abutting edge 25 is in engagement therewith, either cross tee 2 can be moved out of vertical alignment with the other, in opposite directions, as illustrated in FIGS. 6 and 7, while maintaining the cross tee interlock because the spring retainers hold the detents 24 in the cutouts 27 as the detent edge 25 of the moving cross tee is moved along shoulder 28.

Figure 9:
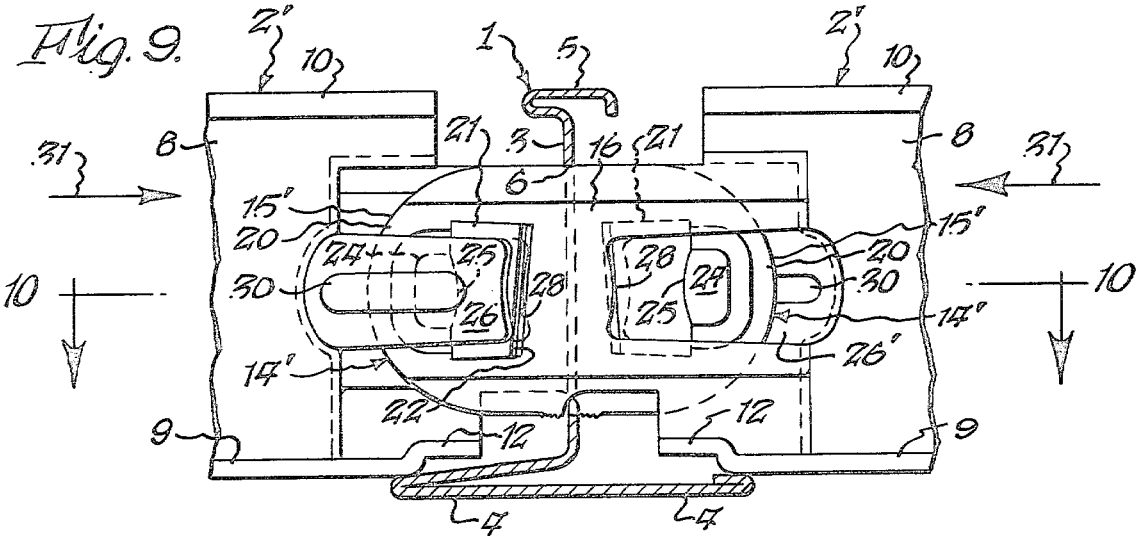
FIG. 9 is a view like that of FIG. 8 but taken after axial expansion of the cross tees in the direction indicated by the arrows.
Figure 10:
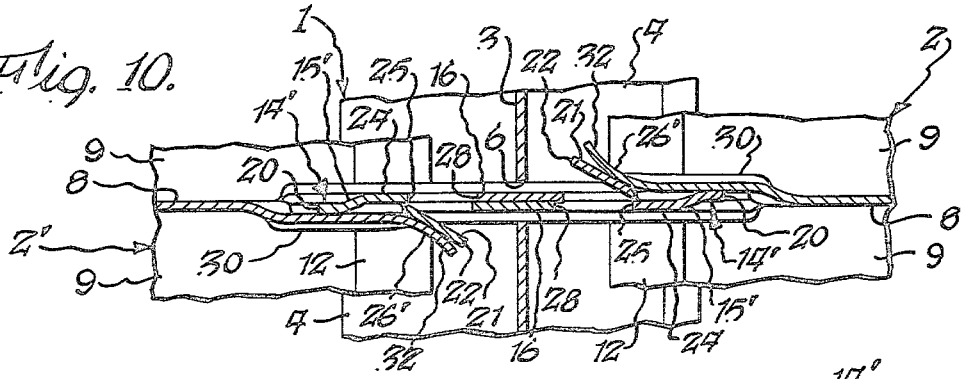
FIG. 10 is a longitudinal sectional view thereof taken about on line 10—10 of FIG. 9.
Figure 11:
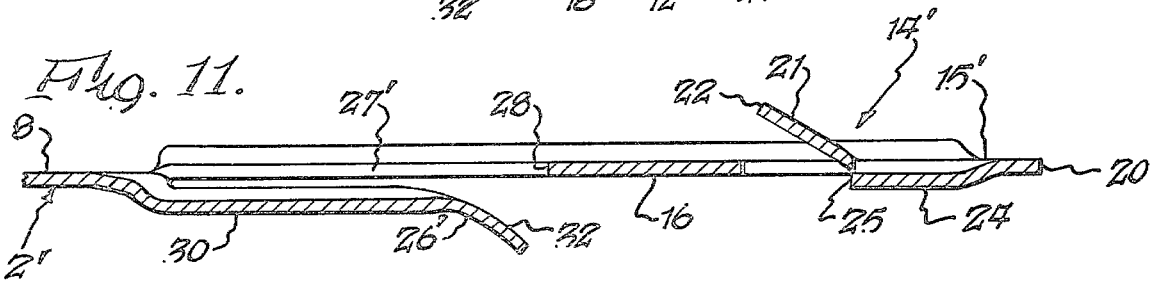
FIG. 11 is a view like that of FIG. 4, but showing the modified locking connector of FIGS. 8–10.

It has been found that with the locking connection of this invention cross tees 2 will maintain their interlock under tension loads in excess of 300 pounds in straight pull, and with the cross tees angularly shifted horizontally or vertically by as much as five degrees. Therefore, the locking connection of this invention not only provides a very high degree of pull apart resistance, but does so in a manner accommodating relative angular movement between the interlocked cross tees.

Where building codes or other circumstances require supporting grid systems capable of undergoing expansion, for example during a fire, for a predetermined period of time without losing the integrity of the ceiling, the heat induced expansion of the cross tee supporting members must be accommodated. Upon expansion cross tees 2 seek to move further inwardly of the slot 6. This is accomplished with the locking connection of my invention using the modified construction shown in FIGS. 8–10. The various parts are the same as or very similar to those shown in FIGS. 1–7 and therefore the same reference numerals are used, with the reference numerals for those parts which are modified to accommodate such expansion movement being primed to indicate modification. Each cross tee 2' has a locking connector 14' identical to that previously described except that the spring retainer 26' is elongated, inwardly or rearwardly from the finger 21 and detent 24 which remain the same. The cutout 27' is corresponding elongated, to accommodate inward movement of the opposing detent 24, and the stop 23 is modified so as to be a shearable stop 23'. A reinforcing embossment or rib 30 is provided on the elongated spring retainer 26'. In normal operation, the locking connection of FIGS. 8–11 is assembled and behaves precisely as described with reference to embodiments of FIGS. 1–7, the stops 23' limiting insertion movement of the locking connector tongues. However, in the event of fire causing movement of the respective cross tees 2' toward main tee 1 in the direction of arrow 31 in FIG. 9, the stops 23' shear, permitting passage of the tongues further into slot 6. The elongated retainers 26' and slots 27' accommodate such inward movement of the opposing tongue while maintaining the assembled locking connectors interlocked, as shown in FIGS. 9 and 10. The spring retainers 26' continue to maintain the assembled connectors interlocked in side by side relation, even if they undergo relative angular movement vertically or horizontally, as previously described. In the event of separating movement, in a direction opposite the direction of arrows 31, the detent edges 25 and shoulders 28 are reengaged, to prevent separation.

The forward end portion 32 of the spring retainers 26, 26' is curved outwardly, as shown, to facilitate passage of the opposing tongue between the spring retainer and tongue web 16. Stops 23, 23' limit insertion of the cross tees during assembly, and preferably are spaced from finger 21 a distance no greater than the thickness of main tee web 3.

Accordingly it is seen that this invention fully accomplishes its intended objects. While only two embodiments have been illustrated, disclosed and described in detail that has been done by way of illustrations, and it will be appreciated that the terms forward and rearward are used herein only to designate relative direction.

What is claimed is:

1. A locking connection for supporting grid systems comprising a first support member having a flange and a web upstanding therefrom, said web having a slot therein, a pair of second support members each having a flange and a web upstanding therefrom, said second member webs being provided with axially projecting locking connectors insertable from opposite directions through said slot in side-by-side relation, each of said connectors having a resiliently yieldable finger engageable against said first member web after insertion through said slot for interlocking said first and second members together, and means interlocking said connectors together in an assembled relation preventing relative separating movement of said second members away from each other, said last-named means comprising, for each connector, a detent projecting laterally from the side of said connector opposite said finger, means defining an opening in said connector providing an arcuate generally vertical shoulder axially spaced rearwardly from said detent, and a spring retainer projecting laterally from the same side of said connector as said detent and extending forwardly at least partially across said opening and toward said shoulder, whereby when said connectors are inserted through said slot in side-by-side relation the forward end of each connector is confined against the other connector by the retainer thereof with the detent of each connector engaging the arcuate shoulder of the other connector, said retainers yielding resiliently to permit passage of said detents into said openings for engagement with said shoulders, said arcuate shoulders accommodating relative generally vertical angular movement of said second support members, and said retainers resiliently retaining said detents and shoulders engaged upon relative generally horizontal and vertical angular movement of said second supporting members.

2. A locking connection as set forth in claim 1, each said detent having a rearwardly facing arcuate edge portion abutting said arcuate shoulder in engagement therewith.

3. A locking connection as set forth in claim 1, said detents being positioned adjacent the juncture between said fingers and said connectors.

4. A locking connection as set forth in claim 1, the forward portion of each said retainer flaring outwardly to facilitate assembly of said connectors in interlocked relation.

5. A locking connection as set forth in claim 1, together with stop means on said second support members engageable against said first member web to limit insertion of said connector through said slot during assembly of said first and second members.

6. A locking connection as set forth in claim 5, said stop means yielding upon axial expansion of said second support members to permit further movement of said connectors through said slot, each said opening and retainer being axially elongated to accommodate such further movement without separation of the interlocked connectors.

7. A locking connection as set forth in claim 1, said arcuate shoulders being of substantially greater vertical extent than that shoulder engaging portion of said detents.

8. A support member for supporting grid systems of the type comprising right angularly related support members each having a flange and a web upstanding therefrom, the web of one such member having a slot therein and the web of the other such member having a locking connector extending axially therefrom for insertion through the slot to interlockingly engage the members and for interlocking engagement with an opposing connector, said support member comprising a flange and a web upstanding therefrom, a locking connector extending axially from said web, a resiliently yieldable finger extending laterally and rearwardly from said connector in axially spaced relation to the forward edge thereof for engagement with one side of the web of a right angularly related support member, a rearwardly facing detent projecting laterally from the side of said connector opposite said finger in similarly spaced relation to said forward edge, means defining an opening in said connector providing an arcuate generally vertical shoulder in axially rearwardly spaced relation to said detent and to the outer edge of said finger for engagement with the detent of an opposing connector, and a spring retainer projecting laterally from the same side of said connector as said detent and extending forwardly at least partially across said opening, the lateral spacing of said retainer relative to the adjacent portions of said connector being less than the lateral dimension of said connector including said detent whereby said retainer will resiliently yield to permit passage of the detent of an opposing connector into said opening for engagement with said shoulder and will thereafter maintain such engagement.

9. A support member as set forth in claim 8, together with a shearable stop on said connector between the outer edge of said finger and said shoulder, said opening and said spring retainer extending axially rearwardly from said shoulder a distance substantially greater than the spacing between said detent and said forward edge thereby to accommodate expansion induced movement of an opposing connector.

10. A locking connection for supporting grid systems comprising a first support member having a flange and a web upstanding therefrom, said web having a slot therein, a pair of second support members each having a flange and a web upstanding therefrom, said second member webs being provided with axially projecting locking connectors insertable from opposite directions through said slot in side-by-side relation, each of said connectors having resiliently yieldable means engageable against said first member web after insertion through said slot for interlocking said first and second members together, stop means normally limiting insertion of said connectors through said slot and yielding upon axial expansion of said second support members to permit further movement of said connectors through said slot, and means interlocking said connectors together in an assembled relation preventing relative separating movement of said second members away from each other, said last-named means comprising, for each connector, a laterally projecting detent and a shoulder axially spaced rearwardly from said detent for interlocking engagement with the corresponding detent and shoulder of the opposing connector, said interlocking means including means maintaining the interlock between said second support member connectors while accommodating such further movement thereof through said slot.

* * * * *